United States Patent [19]

Cobb et al.

[11] Patent Number: 4,997,550

[45] Date of Patent: Mar. 5, 1991

[54] METHOD FOR IMPROVED FLOTATION OF DISCOLORING IMPURITIES FROM KAOLINITE

[75] Inventors: Gary L. Cobb, Davisboro; Dursun E. Ince, Milledgeville, both of Ga.

[73] Assignee: ECC America Inc., Atlanta, Ga.

[21] Appl. No.: 435,774

[22] Filed: Nov. 13, 1989

[51] Int. Cl.[5] ..... B03D 1/12; B03D 1/2

[52] U.S. Cl. ..... 209/166; 209/167

[58] Field of Search ..... 209/166, 167; 252/61

[56] References Cited

U.S. PATENT DOCUMENTS

| | | | |
|---|---|---|---|
| 3,266,917 | 8/1966 | Sawyer | 209/166 |
| 3,282,715 | 11/1966 | Sawyer | 209/166 |
| 3,337,048 | 8/1967 | Mercade | 209/166 |
| 3,450,257 | 6/1969 | Cundy | 209/166 |
| 3,462,013 | 8/1969 | Mercade | 209/166 |
| 3,503,499 | 3/1970 | Allegrini | 209/166 |
| 3,594,203 | 7/1971 | Sawyer | 209/166 |
| 3,655,038 | 4/1972 | Mercade | 209/166 |

*Primary Examiner*—David L. Lacey
*Assistant Examiner*—Thomas M. Lithgow
*Attorney, Agent, or Firm*—Klauber & Jackson

[57] ABSTRACT

Flotation of a kaolin clay slurry to remove titanium-based impurities is improved by adding a biocide to the slurry prior to the flotation and effecting the flotation in the presence of the biocide. The addition of the biocide improves the efficacy of flotation and thereby increases the brightness of the clay. Preferred biocides are tetrahydrothiadiazine thiones, especially tetrahydro-3,5-dimethyl-2H-1,3,5-thiadiazine-2-thione.

15 Claims, No Drawings

METHOD FOR IMPROVED FLOTATION OF DISCOLORING IMPURITIES FROM KAOLINITE

FIELD OF THE INVENTION

This invention relates generally to methods for beneficiation of kaolins and other clays, and more specifically relates to improvements in the flotation methodology which is commonly employed for removing titaniferous discolorants from kaolin clays to improve the brightness of such clays.

BACKGROUND OF THE INVENTION

Natural clays, including kaolin clays, frequently include discoloring contaminants in the form of iron and/or titanium-based impurities. Quantities of titanium-based impurities are particularly significant in the case of the sedimentary kaolins of Georgia, where such impurities are commonly present as iron-stained aratase and rutile. In order, therefore, to refine the clay and bring the brightness characteristics of the resultant product to a level acceptable for such applications as paper coating, various techniques have been used in the past to remove such discoloring impurities. Thus, for example, hydrosulfites have been widely used for converting at least part of the iron-based (or "ferruginous") impurities to soluble forms, which may then be removed from the clay.

Among the most effective methods for removing titaniferous impurities, including, e.g., iron-stained anatase, are the well-known froth flotation techniques. Flotation is, of course, a technique commonly used in the ore-separation art for the treatment of ores, and a wide variety of so-called collecting agents have been proposed for ore flotation, such as the di-thiocarbonates and related compounds disclosed in Harris U.S. Pat. No. 3,590,996, and Harris et al, U.S. Pat. No. 3,853,751. When flotation methods are applied in the kaolin art, an aqueous suspension or slurry of the clay is formed, the pH of the slurry is raised to an alkaline value, for example, by addition of ammonium hydroxide, and a collector or collecting agent is added. The slurry is then conditioned by agitating the same for a sustained period. A frothing agent, for example, pine oil, is added to the conditioned slurry, after which air is passed through the slurry in a froth flotation cell, to effect separation of the impurities along with the collector agent. After the flotation step, the flotation beneficiated clay may be subjected to an additional treatment or treatments to remove or modify further discolorants—hydrosulfite bleaching. Similarly, in Nott, U.S. Pat. No. 3,974,067, the purified product from the flotation treatment is subjected to magnetic separation, to remove further magnetically responsive discolorants.

Details regarding the use of flotation techniques for removing titanium-based impurities from kaolins, may be found at numerous points in the prior art, including, for example, in U.S. Pat. No. 3,450,257 to E. K. Cundy. The Cundy disclosure is illustrative of goodly portions of the prior art, wherein fatty acids such as oleic acid, have been utilized as the collector agents appropriate and effective for use where titanium-based impurities are to be removed from kaolin clays. Further details of flotation treatment are set forth in numerous other patents of the prior art, as for example, in U.S. Pat. Nos. 2,990,958; 3,138,550 and 3,450,257.

In kaolin clay products, especially those to be used for paper coating and the like, brightness is indeed an extremely important consideration, and much effort is exerted in improving the brightness of the clay—as measured by the standard G.E. scale (see TAPPI Procedure T-646-os-75). Even an improvement of less than a full point can be very significant.

OBJECTS OF THE INVENTION

In accordance with the foregoing, it may be regarded as an object of the present invention, to provide a process for improving the flotation step in the beneficiation of kaolin clays, as to increase the efficiency of same and to thereby provide a clay product of increased brightness.

It is a further object of the invention, to provide a process of the character indicated, wherein an additive to the froth flotation operation enhances the flotation step as to increase the brightness of the resultant clay product, and simultaneously serves to reduce bacterial and fungal contamination in important processing portions of the industrial plant in which the kaolin is processed.

SUMMARY OF THE INVENTION

Now, in accordance with the present invention, it has been unexpectedly found that small amounts of biocides, when added to the clay slurry prior to flotation (e.g. during the initial aqueous blunging and conditioning of the crude clay), have a significantly beneficial effect upon the flotation step, and lead to a flotated clay product of markedly increased brightness. Since these germicidal agents are added to the clay during early processing stages—e.g., during makedown of the crude kaolin—they have the added beneficial effect of reducing bacterial and fungal incidence in the plant equipment used for blunging and conditioning the clay, and in the float cells proper, all of which contributes to the increase in ultimate product brightness. While the precise mechanism or mechanisms responsible for the unexpected benefits yielded by the invention are not completely understood, it is hypothesized that the biocide by destroying bacteria and fungi present in the crude clay, may thereby preclude the slime-like micro-organisms coatings or deposits which could be generated by bacteria in the presence of the moisture and elevated temperature conditions provided during the clay processing steps preceding and incident to flotation. Such coatings and/or deposits could interfere with the mechanisms of flotation, e.g., by creating chemical or physical barriers at the surfaces of the contaminants and the clay particles which inhibit the selective attachment of the surfactants to the impurity surface.

DETAILED DESCRIPTION OF THE PREFERRED EMBODIMENTS

Particularly effective as biocidal agents suitable for use in accordance with the invention, are the hydrocarbon-substituted tetrahydro thiadiazines, such as tetrahydro-3,5-dimethyl-2H-1,3,5-thiadiazine-2-thione and tetrahydro-3,5-bis(phenylmethyl)-2H-1,3,5-thiadiazine-2-thione, and the like, the former of which is sold commercially by various producers, e.g., by Merck and Co., under the trademark METASOL ® D3T-A and under the trademark NALCON by Nalco Chemical Co. In other words, these preferred fungicidal agents are compounds of the formula

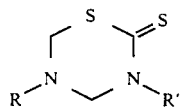

wherein R and R′ are alkyl or alkaryl of up to 10 carbon atoms, i.e. alkyl of 1 to 10C and alkaryl of 7–10C. Other biocidal agents suitably used include 1,2 benzisothiazolin-3-one (BIT), which is, for example, available as a 30% solution in aqueous ethylene diamine under the trademark PROXEL® CRL from ICI Americas Inc. It is known to utilize tetrahydro-3,5-dimethyl-2H-1,3,5-thiadiazine-2-thione as a germicidal agent for addition to dispersed aqueous clay slurries which have already undergone flotation in conventional manner, as described in Sawyer et al, U.S. Pat. No. 3,282,715. Such post-flotation addition, however, obviously has no effect upon the flotation step itself and the efficacy of such flotation in the elimination of discolorants. Indeed, since the objective of the prior art such as Sawyer is to disable microorganisms in the ready-to-be shipped slurry, these benefits would be lost by addition prior to flotation, in that the acid-flocculation step which commonly is used after flotation would destroy the germicidal agent. Surprisingly, and unexpectedly, however, the pre-flotation addition of biocides such as tetrahydro-3,5-dimethyl-2H-1,3,5-thiadiazine-2-thione, and the like, brings about improved flotation and yields an improved product clay brightness. Such biocidal agents also, of course, exert their biocidal activity in the industrial plant processing line which they contact, e.g., at the clay makedown tanks, float cells, etc., and thereby serve to reduce undesired bacterial and fungal growth in these important processing facilities.

The biocides can be added to the clay slurry prior to flotation in any convenient form, advantageously as liquids, and preferably in a water-soluble form in solution as a salt, or otherwise.

Only small amounts of the biocidal agents are required to be effective as flotation enhancers and clay brightness improvers. For example ½ to 4 pounds, preferably ½ to 3 pounds, and more preferably 1 to 2 pounds of biocide per ton of dry clay are suitably used. Mixtures of the biocidal agents can also be employed.

In accordance with the invention, the flotation is therefore carried out in conventional manner, with the exception that the clay slurry subjected to the flotation step has had a biocidal agent added to it.

A number of tests were run to demonstrate the efficacy of the present invention wherein crude discolored kaolin clays were subjected to flotation treatment as disclosed herein, with the products of such treatment being compared with a product produced by flotation effected with the most common collector agent of the prior art, i.e., oleic acid. Clays used in these tests were sedimentary soft Georgia kaolins, typically having a crude $TiO_2$ content of about 1.5 to 2.0%.

In a typical procedure, the crude clay is blunged and conditioned by forming an aqueous alkaline dispersion of the clay, the pH being adjusted in the range of 7 to 10 with ammonium hydroxide or sodium hydroxide. The dispersion is carried out with the addition of sodium silicate in the range of 0.5 to 10 lbs/ton of solids. If dispersion is very difficult, a polyacrylate is added to the slurry in the range of 0.1 to 5 lbs/ton of solids. Oleic acid as a collector agent, plus METASOL or other biocide for the tests illustrating the invention, is added to the clay slurry and the slurry conditioned in conventional manner for 15 minutes. For some tests, an aluminum salt, e.g., alum, and a collector sold under the name "GAFAC", which is understood to be a non-ionic surface active phosphate ester described in U.S. Pat. No. 3,567,636, is also added to the slurry.

The slurry during blunging and conditioning operations may have from about 25 to 65% solids. The conditioning process is preferably continued for sufficient time to dissipate at least 25 hp-hr of energy per ton of solids, although generally the invention is effective even where as little as 10 hp-hr per ton of solids is dissipated. The blunged and conditioned slurry was subjected to a conventional treatment in a flotation cell.

After flotation of the impurities is completed, the slurry is screened on a 325 mesh screen to remove sand. The slurry is then batch centrifuged to obtain 90 to 94% less than 2 micron size in the product, after which it is flocced, filtered, dried, and pulverized. The brightness values stated in all the following Examples are G.E. brightness values of the pulverized product which have been obtained according to the standard specification established by TAPPI procedure T646 OS-75.

EXAMPLE I

A kaolin clay which was a blend of several coarse particle size cream Georgia kaolins and having a feed $TiO_2$ content of 1.36% was processed as described above. Flotation was carried out using concentrations of the various components set forth in Table I. To compare performance, METASOL D3TA was added in one case to the clay slurry during blunging and conditioning, i.e., during makedown and before flotation, and the effect of this biocide pre-addition was measured against the prior art technique of using only a conventional flotation agent. The results are set forth in Table I.

TABLE I

| | Conventional Flotation (Oleic Acid) | Conventional Flotation and METASOL |
|---|---|---|
| Polyacrylate | 0.5 lbs/ton | 0.5 lbs/ton |
| Sodium silicate | 1 lb/ton | 1 lb/ton |
| Ammonium hydroxide | 3.3 lbs/ton | 3.3 lbs/ton |
| Oleic acid | 7.3 lbs/ton | 7.3 lbs/ton |
| METASOL | | 4 lbs/ton |
| pH | 9.5 | 9.5 |
| Solids, % | 60 | 60 |
| Conditioning time | 15 minutes | 15 minutes |
| Resultant G.E. Product Brightness | 84.3 | 85.6 |
| % $TiO_2$ in Product | 1.14% | 0.87% |

EXAMPLE II

The procedure of Example I was repeated with the clay therein described, but less METASOL was added to the slurry. Flotation was carried out using concentrations of the various chemicals set forth in Table II. The results are set forth in Table II.

TABLE II

| | Conventional Flotation (Oleic Acid) | Conventional Flotation and METASOL |
|---|---|---|
| Polyacrylate | 0.5 lbs/ton | 0.5 lbs/ton |
| Sodium silicate | 1 lb/ton | 1 lb/ton |
| Ammonium hydroxide | 3.3 lbs/ton | 3.3 lbs/ton |
| Oleic acid | 7.3 lbs/ton | 7.3 lbs/ton |
| METASOL | | 2 lbs/ton |

TABLE II-continued

| | Conventional Flotation (Oleic Acid) | Conventional Flotation and METASOL |
|---|---|---|
| pH | 9.5 | 9.5 |
| Solids, % | 60 | 60 |
| Conditioning time | 15 minutes | 15 minutes |
| Product Brightness | 84.3 | 85.5 |
| % $TiO_2$ | 1.14% | 0.96% |

It will be observed from Table II that the biocidal agent improves clay brightness even when present in very small amounts.

EXAMPLE III

The procedure of Example I was repeated with the clay therein described, but some alum and GAFAC were added to the slurry in each case. Flotation was carried out using concentrations of the various chemicals set forth in Table III. The results are set forth in Table III.

TABLE III

| | Conventional Flotation (Oleic Acid) | Conventional Flotation and METASOL |
|---|---|---|
| Polyacrylate | 0.5 lbs/ton | 0.5 lbs/ton |
| Sodium silicate | 1 lb/ton | 1 lb/ton |
| Ammonium hydroxide | 3.3 lbs/ton | 3.3 lbs/ton |
| Oleic acid | 7.3 lbs/ton | 7.3 lbs/ton |
| METASOL | | 4 lbs/ton |
| GAFAC | 0.20 lbs/ton | 0.20 lbs/ton |
| Alum | 0.33 lbs/ton | 0.33 lbs/ton |
| pH | 9.5 | 9.5 |
| Solids, % | 60 | 60 |
| Conditioning time | 15 minutes | 15 minutes |
| Product Brightness | 85.1 | 86.1 |
| % $TiO_2$ | 0.93% | 0.84% |

EXAMPLE IV

The procedure of Example III was repeated with the clay therein described, but less METASOL was added to the slurry. Flotation was carried out using concentrations of the various components set forth in Table IV. The results are set forth in Table IV.

TABLE IV

| | Conventional Flotation (Oleic Acid) | Conventional Flotation and METASOL |
|---|---|---|
| Polyacrylate | 0.5 lbs/ton | 0.5 lbs/ton |
| Sodium silicate | 1 lb/ton | 1 lb/ton |
| Ammonium hydroxide | 3.3 lbs/ton | 3.3 lbs/ton |
| Oleic acid | 7.3 lbs/ton | 7.3 lbs/ton |
| METASOL | | 2 lbs/ton |
| GAFAC | 0.20 lbs/ton | 0.20 lbs/ton |
| Alum | 0.33 lbs/ton | 0.33 lbs/ton |
| pH | 9.5 | 9.5 |
| Solids, % | 60 | 60 |
| Conditioning time | 15 minutes | 15 minutes |
| Product Brightness | 85.1 | 85.9 |
| % $TiO_2$ | 0.93% | 0.84% |

It will be observed from Table IV that the fungicidal agent again improves clay brightness significantly even when present in very small amounts.

EXAMPLE V

In this Example, a blend of several coarse and fine cream Georgia kaolin crudes was used, and the procedure of Example I was followed. The experimental details and results are given in Table V.

TABLE V

| | Conventional Flotation | METASOL Flotation |
|---|---|---|
| Polyacrylate | 0.5 lbs/ton | 0.5 lbs/ton |
| Sodium silicate | 1 lb/ton | 1 lb/ton |
| Ammonium hydroxide | 3.3 lbs/ton | 3.3 lbs/ton |
| Oleic acid | 7.3 lbs/ton | 7.3 lbs/ton |
| METASOL | | 2 lbs/ton |
| pH | 9.5 | 9.5 |
| Solids, % | 60 | 60 |
| Conditioning Time | 15 minutes | 15 minutes |
| Product Brightness | 87.3 | 89.0 |
| % $TiO_2$ in Product | 0.99% | 0.86% |

The procedure of Example V was repeated using 1 and 3 lbs/ton of the same METASOL. Floated product brightness of 88.7 and 89.0 were obtained.

EXAMPLE VII

In this Example, a blend of several coarse particle size cream Georgia kaolin crudes was used, and the procedure of Example I was followed. The experimental details and results are given in Table VI.

TABLE VI

| | Conventional Flotation | METASOL Flotation |
|---|---|---|
| Polyacrylate | 0.5 lbs/ton | 0.5 lbs/ton |
| Sodium silicate | 1 lb/ton | 1 lb/ton |
| Ammonium hydroxide | 3.3 lbs/ton | 3.3 lbs/ton |
| Oleic acid | 7.3 lbs/ton | 7.3 lbs/ton |
| METASOL | | 2 lbs/ton |
| pH | 9.5 | 9.5 |
| Solids, % | 60 | 60 |
| Conditioning Time | 15 minutes | 15 minutes |
| Product Brightness | 88.0 | 88.8 |
| % $TiO_2$ | 0.66% | 0.56% |

EXAMPLE VIII

The procedures of Example VII were repeated using 1.0 and 2.0 lbs/ton of the same METASOL. Floated product brightness of 88.7 and 88.5 were obtained.

EXAMPLE IX

A further sample of a crude kaolin characterized as a mixture of several coarse cream Georgia kaolins was used in this Example. The crude samples were blunged using 0.23 lbs/ton of a sodium polyacrylate, 2.4 lbs/ton sodium silicate, 6.0 lbs/ton oleic acid and 2.0 lbs/ton biocide (except control), at 9.5 to 10 pH. 8.0 lbs/ton of sodium silicate was added after a 15 minute blunge time. An 80 minute flotation time was used.

Both METASOL and PROXEL-CRL provided higher brightness values than the control, with 91.3 and 91.2, respectively. Corresponding titania removal rates were also higher. These results are shown in Table VIII.

TABLE VII

| Test | G.E. Brightness | $TiO_2$ |
|---|---|---|
| Control | 90.7 | .63 |
| METASOL | 91.3 | .53 |
| PROXEL-CRL | 91.2 | .49 |

It is clear from Examples V and VI that the pre-addition of a biocidal agent such as METASOL is effective as to improve the flotation process, to thereby remove additional titaniferous impurities, and thus markedly increase the resulting brightness for differing types of kaolin clays.

It will be obvious that various changes and modifications may be made without departing from the invention as defined in the appended claims. It is intended, therefore, that all matter contained in the foregoing description be interpreted as illustrative only and not in a limiting sense.

We claim:

1. In the method for beneficiating a kaolin clay containing discoloring titaniferous contaminants, by subjecting said clay as an aqueous slurry to froth flotation, to remove with the froth significant quantities of said contaminants; the improvement comprising:

conducting said flotation in the presence of a germicidally and fungacidally effective amount of a biocide, thereby facilitating separation of said impurities and to improve the brightness of the beneficiated kaolin clay.

2. A flotation method as defined in claim 1, wherein said biocide is a tetrahydrothiadiazine thione of the formula

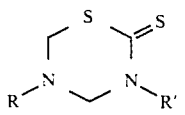

wherein R and R′ are alkyl or aralkyl of up to 10 carbon atoms.

3. A flotation method as defined in claim 2, wherein R and R′ are methyl.

4. A method in accordance with claim 2, wherein said biocide comprises tetrahydro-3,5-dimethyl-2H-1,3,5 thiadiazine-2-thione.

5. A method in accordance with claim 1, wherein said biocide comprises 1,2-benzisothiozolin-3-one.

6. A method as defined in claim 1, wherein from ½ to 4 lbs/ton of dry clay of said biocide is added to said slurry prior to flotation.

7. A method in accordance with claim 6, wherein ½ to 3 lbs/ton of dry clay of said biocide are added.

8. A method in accordance with claim 6, wherein 1 to 2 lbs/tons of dry clay of said biocide are added.

9. A method in accordance with claim 2, wherein said slurry is formed by initially blunging and conditioning said kaolin clay containing said discoloring contaminants; and wherein said biocide is added during said blunging and conditioning steps.

10. A process of improving the flotation of a kaolin clay slurry to produce a kaolin clay of increased brightness which comprises adding a germidically and fungacidally effective amount of a biocide to said slurry prior to subjecting the slurry to flotation, subjecting said clay slurry containing said biocide to flotation in the presence of said biocide to thereby improve the brightness of the kaolin clay.

11. A process as defined in claim 10, wherein said biocide is a tetrahydrothiadiazine thione having the formula

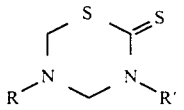

wherein R and R′ are alkyl or aralkyl of up to 10 carbon atoms.

12. A process as defined in claim 11, wherein R and R′ are methyl.

13. A process as defined in claim 10, wherein said biocide comprises 1,2-benzisothiozolin-3-one.

14. A process as defined in claim 10 wherein from ½ to 4 lbs/ton of dry clay of said biocide are added.

15. A process as defined in claim 10, wherein from 1 to 2 lbs/ton of dry clay of said biocide are added.

* * * * *